United States Patent [19]

Freychet et al.

[11] Patent Number: 4,781,245

[45] Date of Patent: Nov. 1, 1988

[54] DEVICE FOR POSITIONING A ROTATABLE ELEMENT WITHIN A TUBE

[75] Inventors: David Freychet; Roben Loutaty, both of Le Havre, France

[73] Assignee: Compagnie De Raffinage Et De Distribution Total France, Paris, France

[21] Appl. No.: 2,110

[22] Filed: Jan. 12, 1987

[30] Foreign Application Priority Data

Jan. 10, 1986 [FR] France ..... 86 000293

[51] Int. Cl.[4] ..... F28G 1/12; F28G 3/08

[52] U.S. Cl. ..... 165/94; 165/95; 15/104.05; 138/38

[58] Field of Search ..... 165/94, 95; 138/38; 15/104.05

[56] References Cited

U.S. PATENT DOCUMENTS

| | | | |
|---|---|---|---|
| 3,407,871 | 10/1968 | Penney | 138/38 |
| 3,743,250 | 7/1973 | Fitzhugh et al. | 138/38 |
| 4,174,750 | 11/1979 | Nichols | 165/95 |
| 4,415,022 | 11/1983 | Baron et al. | 165/95 |
| 4,489,776 | 12/1984 | Baron | 165/95 |
| 4,583,585 | 4/1986 | Estienne et al. | 165/94 |
| 4,595,047 | 6/1986 | Estienne | 165/95 |

FOREIGN PATENT DOCUMENTS

| | | | |
|---|---|---|---|
| 457572 | 3/1928 | Fed. Rep. of Germany | 165/134.1 |
| 0207642 | 3/1964 | Fed. Rep. of Germany | 165/95 |
| 1900732 | 8/1970 | Fed. Rep. of Germany | 165/95 |
| 2073357 | 10/1971 | France . | |
| 2569829 | 8/1984 | France . | |
| 0008699 | 1/1985 | Japan | 165/95 |
| 0817478 | 3/1981 | U.S.S.R. | 165/95 |
| 842332 | 7/1960 | United Kingdom . | |
| 1577362 | 10/1980 | United Kingdom . | |
| 2073357 | 10/1981 | United Kingdom . | |

*Primary Examiner*—Albert W. Davis, Jr.
*Assistant Examiner*—John K. Ford
*Attorney, Agent, or Firm*—A. Thomas S. Safford

[57] ABSTRACT

The invention concerns a positioning device for a tube cleaning element rotatably driven by fluid passing through the tube. This is particularly useful for heat exchanger tubes. This device includes an open-frame support member (1) having one or more parts (8*a*, 8*b*) (preferably of generally cylindrical shape) for mounting on the outside on one end of said tube, and further includes a spindle (2) mounted for rotation with respect to said frame (1) along the axis of the end of said tube and adapted to be fastened to said rotatable element.

13 Claims, 2 Drawing Sheets

DEVICE FOR POSITIONING A ROTATABLE ELEMENT WITHIN A TUBE

The present invention concerns a device for the maintaining in position by one end thereof a movable element which is rotatably driven within a tube by the action of a fluid. It also concerns the use of this positioning device for a rotating member for preventing fouling of and/or for continuously cleaning a fluid conduit, particularly so as to improve heat transfer.

It is known that materials in suspension as well as materials dissolved in inorganic or organic liquid or gaseous fluids, particularly calcium carbonate in an aqueous solution or coke formed in the course of thermal cracking of hydrocarbons, have a tendency to deposit on the inner walls of the conduits traversed by these fluids. This is true in particular of the tubes of heat exchangers, the efficiency of which decreases very rapidly if the fouling thereof is not slowed down or remedied.

One can, of course, effect intermittent cleaning of these tubes, but this requires shutting down of the exchanger, removal of at least part of its members, and reassembly after the cleaning of the tubes, all of which operations are lengthy and expensive.

For this reason, in actual practice it is preferred to provide movable elements within these tubes, for instance elements of helicoidal shape which are driven in rotation by the fluid and which, whether or not in contact with the inner wall of the tube, by their movement prevent the fouling or cause the cleaning of the tubes and an improvement in the heat transfer (see U.S. Pat. Nos. 4,174,750 and 3,648,754, British Pat. No. 347,904 and French Pat. No. 2,073,357, as well as French Patent Application No. 2 569 829 in the name of the Applicant).

The holding of these parts in position within the tubes however brings up various problems since the said movable parts must retain perfect freedom of movement in rotation, the free circulation of the fliud in the tube must not be impaired thereby, and the installation containing these tubes must not be subjected to too great an increase in the loss of head.

One object of the invention is therefore to propose a device for the holding in position of the end of a movable part which is driven in rotation within a tube traversed by a fluid which results in only a minimum increase in the loss of head of said tube.

Another object of the invention is to provide a device of this type which can be mounted on tubes and removed easily in a very short time so as not to complicate the maintenance operations of the installations of which these tubes are a part.

The invention is also directed at proposing a device of this type which can be used for the holding in position of a rotary member for the preventing of the fouling and/or the continuous cleaning of the tubes of a heat exchanger.

For this purpose, the inveniton has as a preferred embodiment a device for the holding in position at one end of a movable element driven in rotation within a tube by the action of a fluid, characterized by the fact that it comprises, on the one hand, a bearing-frame member one or more parts of which, of generally cylindrical shapė, encompass the outside of one end of said tube and, on the other hand, a spindle, mounted for rotation with respect to the said frame along the axis of the end of the said tube and adapted to be fastened to the element driven in rotation.

The bearing-frame member which encompasses the end of the tube will therefore be fastened by clipping onto the tube. This member may have any shape which permits free passage of the fluid in the tube, for instance a stirrup shape, the ends of the arms of which will have a cylindrical profile permitting them to encompass the end of the outer surface of the tube and the central portion of which connecting the said arms will have an orifice or recess for the holding of the spindle. The ends of the arms of the frame which surround the tube will advantageously be welded at a single point so that the part of said frame surrounding the end of the tube is fastened like a clip on said end. In order to reinforce the clip action, a clamping collar will be provided, if necessary, in order to hold the part of said frame clamping said end in position on the end of the tube.

This frame can advantageously be obtained by cutting from a metal plate and stamping the cut shape in order to obtain the profile of the said frame.

The spindle may comprise in simple fashion a linear portion engaged in an orifice in the bearing frame member, one end of said portion having a hook shape and cooperating with a ring-shaped end of the element driven in rotation, or vice versa, while its other end comprises a head holding it captured on said frame. This spindle will advantageously be made in a single piece.

The shapes of the hook of the spindle and of the ring of the end of the element driven in rotation will preferably be such that the point of contact between these two members will be located substantially in the axis of the tube.

In order to avoid rapid wear of the parts of the head of the spindle and the frame which are in contact, they will be made of materials capable of reducing their friction and an anti-wear washer may advantageously be placed between these parts.

In order better to guide the spindle in the axis of the tube, it would appear advantageous for said anti-wear washer to be of sufficient thickness and for it to be clamped in the bearing-frame member.

Such an arrangement is particularly well-adapted to the holding in position of rotary members for the prevention of fouling and/or the continuous cleaning of the tubes of heat exchangers. The tubes of heat exchanger are, in fact, generally engaged at their two ends in orifices in a tube plate and they protrude slightly beyond these tube plates by a length of a few millimeters, which is sufficient to fasten the bearing-frame part of the device according to the invention to the outside of the end of the protruding tube firmly to each other by clipping.

Another embodiment of the invention therefore consists of applying this device to the holding in position within a tube, particularly a heat-exchanger tube, of the end of a rotary member for the preventing of fouling and/or the continuous cleaning of said tube.

This rotary member may be of any shape known in the art, for instance helicoidal, and be deformable or non-deformable. It may or may not be in contact with the inner wall of the tube. The selection of the rotary member will depend in practice on the nature of the fluid passing through the tube and, in particular, its viscosity, the dimensions of the tube and the losses of head tolerable in the installations of which they form a part.

The accompanying diagrammatic drawings illustrate various embodiments of the device of the invention and its application for the holding of a rotary member for the prevention of fouling and/or the continuous cleaning of a tube traversed by the fluid. In the drawings.

Figure 1:
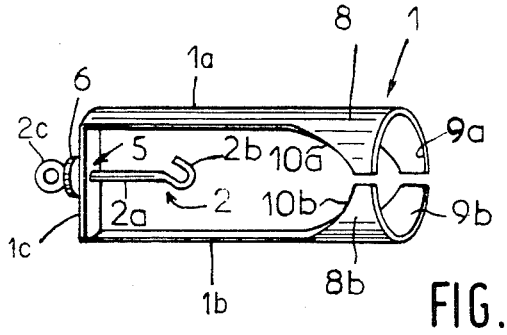
FIG. 1 is a perspective view of a first embodiment of the device.
Figure 2:
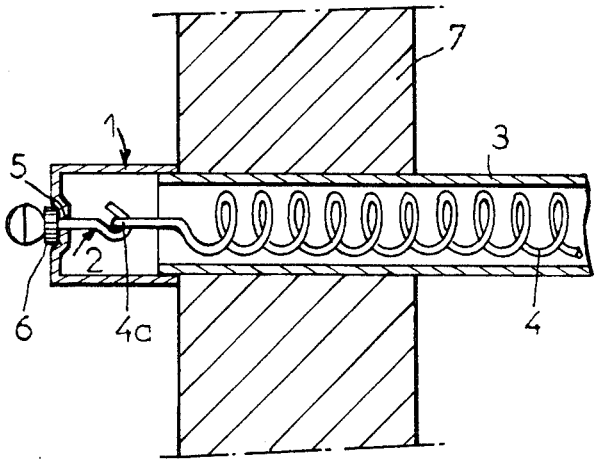
FIG. 2 is a section along the axis of the tube, illustrating the application of this device to the holding of a rotary member.

The device shown in FIGS. 1 and 2 comprises two essential parts, namely a bearing-frame member 1 for a spindle 2. These members may, for instance, be of stainless steel or mild steel.

The member 1 has the shape of a stirrup, of which only the parts 8*a*–8*b* of the ends of the arms 1*a* and 1*b* have the shape of a portion of a cylinder, permitting them to surround the outer surface of the end of a tube 3 through which a fluid passes (FIG. 2) and within which a cleaning member 4, in this case of helicoidal shape, which is driven in rotation by the fluid, is arranged. It will be noted that the shape of the frame 1 is such that it does not substantially retard the passage of a fluid in the tube 3 and creates few losses in head.

The spindle 2 comprises a linear part 2*a* engaged in an orifice 5 present in the center of the part 1*c* connecting the arms 1*a* and 1*b* of the frame 1. One end 2*b* of the spindle 2, positioned between the arms 1*a* and 1*b* of the frame 1, has the shape of a hook while the opposite end 2*c* has a spherical or hemispherical head, preventing the spindle 2 from freeing itself from the frame 1.

In order to limit the wear of the parts of the frame 1 and of the spindle 2 which are in contact with each other, a ring 6 of an antifriction material, for example blued sheet, is interposed between the part 1*c* of the frame and the head 2*c* of the spindle.

As can be noted from FIG. 2, the tube 3 may be a conduit of a heat exchanger the end of which is engaged in a tube plate 7 and protrudes a few millimeters, for instance 3 mm, beyond said plate. The length of protrusion of the tube 3 will be sufficient so that its ends can be clamped by means of the ends 8*a* and 8*b* of the branches 1*a* and 1*b*. In order that this clamping be sufficient to make the frame 1 entirely firmly attached to the tube 3, the edges 9*a* and 9*b* or 10*a* and 10*b* of the ends 8*a* and 8*b* are welded in order to strengthen the opening of the bearing at these ends, the said frame fastening itself like a clip onto the end of the tube. It is clear that the operations of the mounting and dismounting of this device will be extremely rapid, on the order of 35 seconds, for industrial heat exchanger tubes.

The rotary member 4 will have a ring-shaped end 4*a* which will protrude out of the tube 3 and will be hooked to the end 2*b* of the spindle 2.

Figure 3:
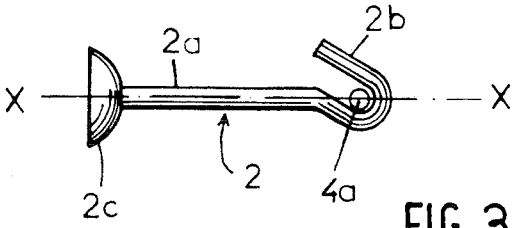
FIG. 3 is a detail view of a preferred embodiment of the spindle of this device.

As shown in FIG. 3, the hook 2*b* of the spindle 2 and the ring 4*a* of the rotary member 4 will have a shape such that the part of the ring housed within the hook is substantially centered on the axis X—X of the conduit 3 so that the spindle 2 can itself be driven in rotation around said axis, without a more complicated movement being imparted to it by the member 4.

Figures 4, 5:
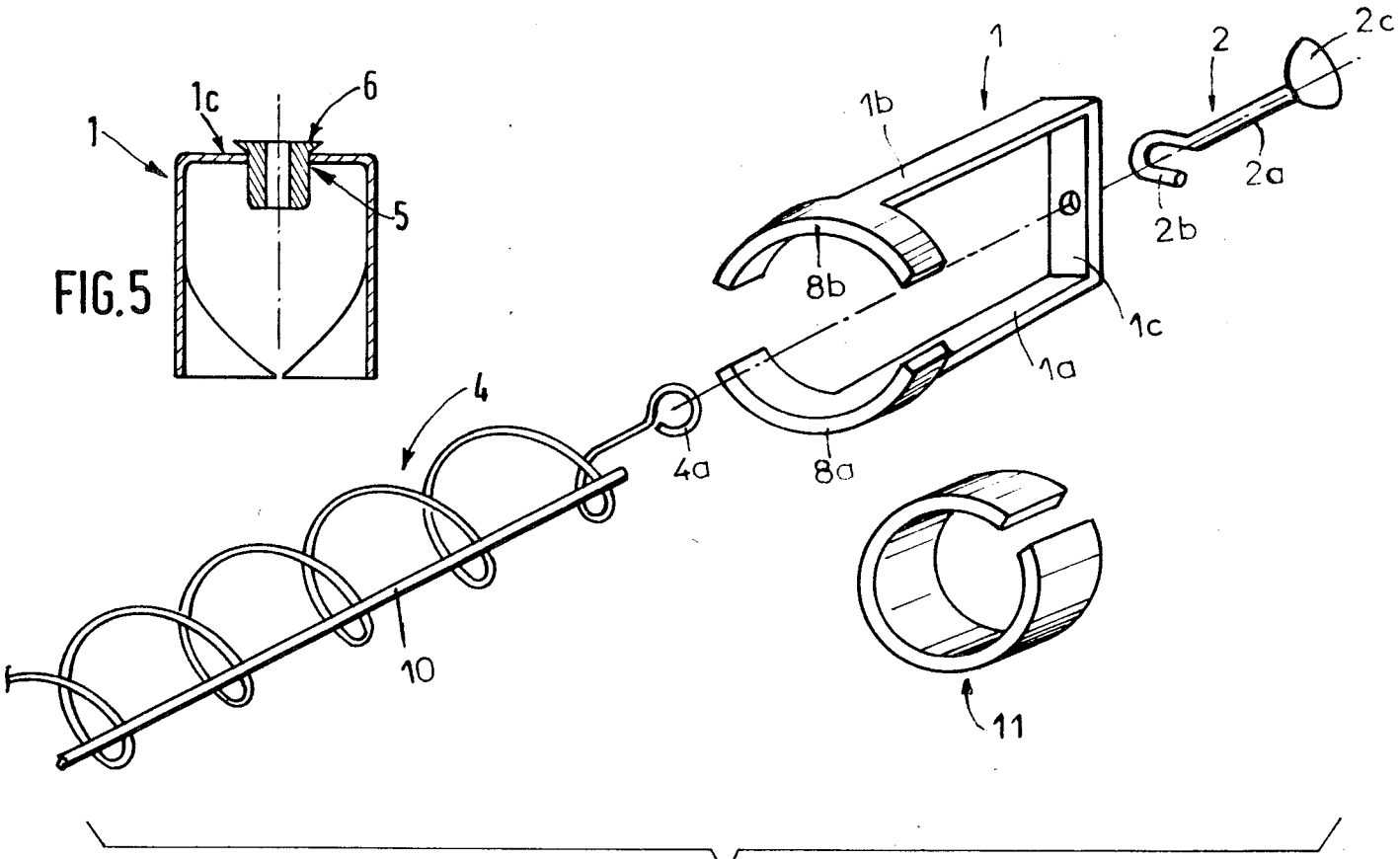
FIG. 4 is an exploded view of another embodiment of the device according to the invention and of another type of rotary member for the prevention of fouling and/or cleaning.
FIG. 5 is a section through the stirrup in which the anti-wear washer is clamped.

In the case of FIG. 4, in which the members already described are designated by the same reference numbers, the ends 8*a*–8*b* of the arms 1*a* and 1*b* of the frame 1 have the shape of a part of a ring and are clamped on the outside, after positioning on the end of the tube to be equipped, by a split clamping collar 11.

It will be noted that in this case the turns of the rotary member 4 are connected by a rod 10 which is welded on them.

There will be noted the great ease with which the device of the invention can be made integral with the end of a tube and of the rotary member housed in it.

The arms 1*a* and 1*b* of the frame 1, in the embodiment of the device shown in FIG. 4, have a total length of 39 mm, of which the width of the parts 8*a* and 8*b* represents only 5 mm. The inside diameter of the parts 8*a* and 8*b* is 25.4 mm and their outside diameter is 27.4 mm.

The linear part 2*a* of the spindle 2 has a length of 10 mm and a diameter of 2 mm, while the head 2*c* is a sphere of a diameter of 5 mm.

The collar 11 has an external diameter of 28 mm, an internal diameter of 27 mm and a width of 5 mm.

This embodiment of the device according to the invention serves to fasten in position the end of a helicoidal rotary member whose turns have a diameter of 15 mm and a pitch of 22 mm and the total length of which is 6 m. This rotary member is formed of a metal wire 1.2 mm in diameter and the turns are connected by a rod of a diameter of 1.2 mm.

In FIG. 5 the anti-wear washer 6 is inserted in the orifice 5 of the part 1*c* of the stirrup 1. This washer is of sufficient thickness to guide the spindle which is introduced into it.

The invention therefore provides a simple and easy means for the holding in position of the end of a rotary member for the prevention of fouling and/or the cleaning of a tube, particularly a heat-exchanger tube.

We claim:

1. A device mountable at the end of a tube of predetermined size and having a circular cross-section for rotatably positioning in the tube a movable element shaped to be driven in rotation within the tube by the action of a fluid flowing through said tube, comprising an open frame member having a base portion in the shape of a longitudinally split circular cylinder and adapted to be secured to the outside of a protruding end of said tube and an upper open support portion shaped to extend across the axis of said tube when mounted thereon without substantially impeding the flow of fluid past said open frame member relative to said tube, and a spindle rotatably mounted on said support portion for rotation along the axis of the end of said tube and adapted to be fastened to one end of said movable element positioned in said tube.

2. A device according to claim 1, wherein said support portion of said frame member has an orifice for receiving said spindle, said spindle further comprising a linear part engaged in said orifice of said frame member, one end of said linear part having a shape adapted for hook-and-eye engagement with said movable element, the other end of said linear part having a head sufficiently larger than said orifice to capture said rotatable spindle on said frame member.

3. A device according to claim 2, further comprising an anti-wear washer interposed between the support portion of said frame member and the head and linear part of said spindle.

4. A device according to claim 3, wherein said washer is clamped in said frame member.

5. A device according to claim 1, wherein the inner diameter of said base portion is slightly smaller than the outer diameter of said tube of predetermined size and said base portion has sufficient spring to grip securely on the outside of the end of said tube when mounted thereon.

6. A device according to claim 1, further comprising a split clamping collar shaped and adapted to fit over and around the base portion of said frame to fasten said frame member to the end of said tube when the frame member is positioned thereon.

7. A device mountable at the end of a tube of predetermined size for rotatably positioning in the tube a movable element shaped to be driven in rotation within the tube by the action of a fluid flowing through said tube, comprising an open frame member having a base portion adapted to be secured to the outside of a protruding end of said tube and an upper open support portion shaped to extend across the axis of said tube when mounted thereon without substantially impeding the flow of fluid past said open frame member relative to said tube, and a spindle rotatably mounted on said support portion for rotation along the axis of the end of said tube and adapted to be fastened to one end of said movable element positioned in said tube, where said frame member has the shape of a stirrup forming a U with a central part and pair of parallelly extending arms, the ends of said arms being of segmented cylindrical shape and said central part having an orifice for holding the spindle.

8. A device according to claim 3, wherein the frame member is mounted on said tube and the arms thereof are welded at a single point to said tube.

9. A device according to claim 7, wherein said support portion of said frame member has an orifice for receiving said spindle, said spindle further comprising a linear part engaged in said orifice of said frame member, one end of said linear part having a shape adapted for hook-and-eye engagement with said movable element, the other end of said linear part having a head sufficiently larger than said orifice to capture said rotatable spindle on said frame member.

10. A device according to claim 9, wherein the shapes of said hook and said eye are such that the part of the eye engaged in said hook is substantially centered on the central axis of said tube.

11. A device according to claim 9, further comprising an anti-wear washer interposed between the support portion of said frame member and the head and linear part of said spindle.

12. A device according to claim 11, wherein said washer is clamped in said frame member.

13. A device according to claim 7, wherein confronting edges of said ends of said arms are welded at a single point.

* * * * *